US007753661B2

(12) United States Patent
Okudera et al.

(10) Patent No.: US 7,753,661 B2
(45) Date of Patent: Jul. 13, 2010

(54) VACUUM PUMP

(75) Inventors: Satoshi Okudera, Yachiyo (JP); Yasushi Maejima, Yachiyo (JP); Yoshiyuki Sakaguchi, Yachiyo (JP)

(73) Assignee: Boc Edwards Japan Limited (JP)

( * ) Notice: Subject to any disclaimer, the term of this patent is extended or adjusted under 35 U.S.C. 154(b) by 1037 days.

(21) Appl. No.: 10/566,774

(22) PCT Filed: Aug. 3, 2004

(86) PCT No.: PCT/JP2004/011069

§ 371 (c)(1),
(2), (4) Date: Jan. 31, 2006

(87) PCT Pub. No.: WO2005/015026

PCT Pub. Date: Feb. 17, 2005

(65) Prior Publication Data

US 2006/0140776 A1 Jun. 29, 2006

(30) Foreign Application Priority Data

Aug. 8, 2003 (JP) ..... 2003-290371
Aug. 25, 2003 (JP) ..... 2003-300215

(51) Int. Cl.
*F04B 39/06* (2006.01)
*H02K 7/09* (2006.01)

(52) U.S. Cl. ..... 417/423.4; 417/423.1; 417/423.8; 310/54; 310/90.5

(58) Field of Classification Search ..... 417/372, 417/373, 423.1, 423.4, 423.8, 423.14
See application file for complete search history.

(56) References Cited

U.S. PATENT DOCUMENTS

| | | | | |
|---|---|---|---|---|
| 3,877,546 | A * | 4/1975 | Shrader | 184/6.18 |
| 4,140,441 | A | 2/1979 | Pattersen | 417/424 |
| 4,929,151 | A | 5/1990 | Long et al. | 415/177 |
| 6,304,011 | B1 * | 10/2001 | Pullen et al. | 310/52 |
| 6,599,108 | B2 * | 7/2003 | Yamashita | 417/423.4 |

FOREIGN PATENT DOCUMENTS

| | | |
|---|---|---|
| EP | 0352688 | 1/1990 |
| EP | 0434911 | 7/1991 |

(Continued)

OTHER PUBLICATIONS

JP 50-252 A (Airco Inc.), Jan. 6, 1975, Publication No. S50-252, publication date Jan. 6, 1975.

*Primary Examiner*—Devon C Kramer
*Assistant Examiner*—Philip Stimpert
(74) *Attorney, Agent, or Firm*—Adams & Wilks

(57) ABSTRACT

A vacuum pump evacuates gas from a chamber by coaction of a rotationally driven rotor and a stator. An electrical equipment section that rotates the rotor is housed within a stator column integral with the stator. A cooling water pipe is buried in a wall of the stator column near the electrical equipment section. One end of the cooling water pipe branches into a plurality of water inlet ports and the other end branches into a plurality of water outlet ports. One pair of water inlet and outlet ports opens to the outside of the vacuum pump at a side surface of the stator column and another pair of water inlet and outlet ports opens to the outside at the underside of the stator column.

13 Claims, 8 Drawing Sheets

FOREIGN PATENT DOCUMENTS

| | | |
|---|---|---|
| JP | 04295199 | 10/1992 |
| JP | 10306788 | 11/1998 |
| JP | 11193793 | 7/1999 |
| JP | 00161286 | 6/2000 |
| JP | 02242877 | 8/2002 |

* cited by examiner

VACUUM PUMP

CROSS-REFERENCE TO RELATED APPLICATION

This application is a U.S. national stage application of International Application No. PCT/JP2004/011069, filed Aug. 3, 2004, claiming priority dates of Aug. 8 and 25, 2003, and published in a non-English language.

Technical Field

The present invention relates to a vacuum pump used for semiconductor manufacturing apparatus and, more particularly, to a vacuum pump in which a cooling water pipe is buried in the wall of a stator column.

Background Art

In a process for performing work in a process chamber of a high vacuum such as a process of dry etching etc. in a semiconductor manufacturing process, a vacuum pump is used as a means for exhausting the gas in the process chamber to generate a high vacuum in the process chamber.

As the vacuum pump, various types of pumps such as a turbo-molecular pump and a thread groove pump are available. For example, as a conventional vacuum pump, a composite vacuum pump in which a turbo-molecular pump and a thread groove pump are compounded is used.

In the vacuum pump, rotating blades and stationary blades provided in multiple stages on the upper inner peripheral surface of a pump case function as a turbo-molecular pump by means of the rotation of a rotor. By the function of the turbo-molecular pump, a downward momentum is given to the introduced gas, and the gas is transferred to the exhaust side. Also, in the vacuum pump, a thread groove and the rotor function as a thread groove pump by means of the rotation of the rotor. By the function of the thread groove pump, gas is compressed from an intermediate flow to a viscous flow and transferred to the gas discharge port side (for example, refer to Patent Document 1).

For example, as shown in FIG. 7, in a conventional vacuum pump 500, a stator column 502*a* is erected on the upper surface of a base 502*b*. In the stator column 502*a*, an electrical equipment section consisting of a drive motor 503*a* and magnetic bearings 503*b* is disposed, and also a rotor 501 projecting from the interior of the stator column 502*a* is provided. The rotor 501 is rotatably held by the magnetic bearings 503*b*, and is rotated by the drive motor 503*a*.

At the upper outer periphery of the rotor 501, rotating blades 506 are provided in multiple stages. These rotating blades 506 and stationary blades 507 provided in multiple stages on the upper inner peripheral surface of the vacuum pump 500 function as a turbo-molecular pump by means of the rotation of the rotor 501. By this turbo-molecular pump, a downward momentum is given to the introduced gas, and the gas is transferred to the exhaust side.

Further, on the lower inner peripheral surface of the vacuum pump 500, a thread stator 508 is provided, and at a position where the thread stator 508 faces to the lower outer periphery of the rotor 501, a thread groove 508*a* is formed. The thread groove 508*a* and the rotor 501 function as a thread groove pump by means of the rotation of the rotor 501. By this thread groove pump, gas is compressed from an intermediate flow to a viscous flow and transferred to the gas discharge port side.

In the above-described vacuum pump 500, since the electrical equipment section consisting of the drive motor 503*a* and magnetic bearings 503*b* is allowed to function by electric power, heat is produced in the electrical equipment section. Due to the produced heat, the vacuum pump 500 has a fear that the drive motor 503*a* is burned and the magnetic bearings 503*b* are destroyed.

To solve this problem, conventionally, the configuration has been such that a cooling water pipe 504 is installed on the outside of the vacuum pump 500, on the lower surface of the stator column 502*a*, and on the outside of the base 502*b*, and cooling water or a refrigerant, such as a liquid or a gas, having a strong heat exchanging action is allowed to flow to cool the electrical equipment section (for example, refer to Patent Document 2).

However, in the conventional vacuum pump 500, since the cooling water pipe 504 is installed on the outside of the vacuum pump 500 and on the outside of the stator column 502*a*, the electrical equipment section and the cooling water pipe 504 are greatly separated from each other. In particular, the drive motor 503*a* having the greatest heat generating effect among the electrical equipment section is arranged approximately in the center of the vacuum pump 500, so that it is greatly separated from the cooling water pipe 504. If the electrical equipment section and the cooling water pipe 504 are separated greatly from each other, a loss of cooling effect occurs during the time when the cooling effect of the cooling water pipe 504 reaches the electrical equipment section, so that the electrical equipment section cannot be cooled effectively.

If the cooling force of the cooling water pipe 504 is increased, the cooling effect can be allowed to reach the electrical equipment section even if the loss of cooling effect occurs. In this case, however, the cooling effect also reaches a gas flow path, for example, in the thread stator 508 other than the electrical equipment section, so that there is a danger that the liquefaction or solidification of gas is promoted, and hence gas molecules are deposited in the vacuum pump 500. When the deposition of gas molecules is considered, there is a limit to the increase in cooling force of the cooling water pipe 504. Consequently, in the case where the cooling water pipe 504 is installed on the outside of the vacuum pump 500, on the lower surface of the stator column 502*a*, and on the outside of the base 502*b*, it is difficult to cool the electrical equipment section with high efficiency.

Also, as a function of this cooling water pipe, the rise in temperatures of the rotating blades and the rotor is depressed.

In the vacuum pump, the rotor and the rotating blades are rotated at a high speed to exhaust the gas in the process chamber, and the rotating blades and the rotor produce frictional heat and compression heat with respect to the gas flow, so that the rotating blades and the rotor have an abnormally high temperature which may exceed the heat-resisting temperature. Therefore, in order to depress the rise in temperatures of the rotating blades and the rotor, the stator column is cooled, and hence the heat of the rotor and the rotating blades is absorbed by the cooled stator column.

Conventionally, to cool the stator column, too, there has been adopted the above-described method, namely, the method in which the cooling water pipe 504 is installed on the outer surface of the base 502*b*, and by installing this cooling water pipe 504, the cooling effect of the cooling water pipe 504 is allowed to reach the upper part of the stator column 502*a* via the base 502*b*, or the method in which the cooling water pipe is installed on the bottom surface of the stator column 502*a*, and the cooling effect of the cooling water pipe is allowed to reach from the bottom surface to the top surface.

However, with this method, the cooling effect of the cooling water pipe 504 decreases in the upper part of the stator column 502*a*, especially near the lower stages of the rotating blades 506.

On the other hand, the cooling effect can be allowed to reach the stator column 502*a* by increasing the cooling capacity of the cooling water pipe 504. However, if the cooling capacity of the cooling water pipe 504 is increased, the cooling effect also propagates, for example, to the thread stator 508, and hence gas molecules deposit in the thread groove 508*a* depending on the semiconductor manufacturing process.

Consequently, there is a limit to the increase in the cooling capacity of the cooling water pipe 504. In order to absorb the heat on the rotor 501 side by means of the cooled stator column 502*a*, it is preferable that the stator column 502*a* be placed as close as possible to the inner peripheral surface of the rotor 501.

For this reason, conventionally, the shape of the outer peripheral surface of the stator column 502*a* has been almost the same as the shape of the inner peripheral surface of the rotor 501.

Therefore, if the shape of the rotor 501 is different, the shape of the stator column 502*a* is also different, and hence the shape of the rotor 502*a* is different from vacuum pump to vacuum pump. Similarly, the bore of a pump case 509, the size of the base 502*b* supporting the pump case 509, the shape of the rotor 501, the shape of the stator column 502*a*, the length and width of the rotating blade 506, and the number of stages in which the rotating blades 506 are disposed are also different from vacuum pump to vacuum pump. The same is true for a vacuum pump of the same mechanism.

The individual reasons for the above will be explained below with reference to FIGS. 8(*a*) and 8(*b*) showing vacuum pumps of the same mechanism.

Vacuum pumps 600 and 700 shown in FIGS. 8(*a*) and 8(*b*) are composite pumps in which a turbo-molecular pump and a thread groove pump are compounded. In the vacuum pump 600, 700, the lower side of a pump case 609, 709 is supported by a base 602*b*, 702*b*, by which an external casing is formed by the pump case 609, 709 and the base 602*b*, 702*b*. The sizes of the pump case 609, 709 and the base 602*b*, 702*b* are substantially regulated for each type of vacuum pump 600, 700.

In the vacuum pump 600, 700, a rotor 601, 701 is disposed, and is rotatably supported by a stator column 602*a*, 702*a* erected on the upper surface of the base 602*b*, 702*b*. The rotor 601, 701 has a shape such as to cover the stator column 602*a*, 702*a*, and is placed as close as possible to the stator column 602*a*, 702*a*. The shape of the rotor 601, 701 is substantially regulated for each vacuum pump. Therefore, to place the stator column 602*a*, 702*a* as close as possible to the rotor 601, 701, the shape of the inner peripheral surface of the rotor 601, 701 is made almost the same as the shape of the outer peripheral surface of the stator column 602*a*, 702*a*, so that the shape of the stator column 602*a*, 702*a* is also substantially regulated for each vacuum pump.

At the upper outer periphery of the rotor 601, 701, rotating blades 606, 706 are provided in multiple stages. As shown in FIGS. 8(*a*) and 8(*b*), the rotating blades 606, 706 provided in multiple stages have different length and width for each stage. Also, as shown in FIGS. 8(*a*) and 8(*b*), even in the vacuum pump of the same mechanism, the length and width of the rotating blade 606, 706 are different, and further the number of stages is also different.

On the lower inner peripheral surface of the pump case 609, 709, a thread pump stator 608, 708 abuts, and a thread groove 608*a*, 708*a* is formed in the inner peripheral surface of the thread pump stator 608, 708, namely, in the surface facing to the lower outer periphery of the rotor 601, 701.

On the outer surface of the base 602*b*, 702*b*, a cooling water pipe 604A, 704A is installed. Also, the cooling water pipe is sometimes installed on the bottom surface of the stator column 602*a*, 702*a* depending on the vacuum pump. In the cooling water pipe 604A, 704A, cooling water or a refrigerant, such as a liquid or a gas, having a strong heat exchanging action is allowed to flow.

First, the reason why the rotating blades 606, 706 are arranged by changing the length and width for each stage is that the required exhaust velocity and compression ratio of the vacuum pump differ according to the scale of process chamber and the manufacturing process. By adjusting the length and width of the rotating blades 606, 706 provided in multiple stages for each stage, the exhaust velocity and compression ratio of vacuum pump, and further the fluid state of gas in the compressed process can be customized. Therefore, as shown in FIGS. 8(*a*) and 8(*b*), even in the vacuum pump 600, 700 of the same mechanism, due to the difference in the required exhaust velocity and compression ratio, the length and width of the rotating blades 606, 706 are different, and also the number of stages in which the rotating blades 606, 706 are disposed is different from vacuum pump to vacuum pump.

For example, in the vacuum pump 700 shown in FIG. 8(*b*), the rotating blades 706 are longer as a whole than the rotating blades 606 of the vacuum pump 600 shown in FIG. 8(*a*). In the vacuum pump 600 shown in FIG. 8(*a*), the rotating blades 606 are arranged in nine stages, whereas in the vacuum pump 700 shown in FIG. 8(*b*), the rotating blades 706 are arranged in seven stages.

The reason why the shape of the rotor 601, 701 is substantially regulated is avoidance of stress concentration. If the length and width of the rotating blades 606, 706 provided in multiple stages are different in each stage, the tensile force by the rotation of the rotor 601, 701 is different in each stage. Therefore, the thickness of the rotor 601, 701 required to resist the tensile force changes, so that the shape of the rotor 601, 701 is regulated.

Therefore, as shown in FIGS. 8(*a*) and 8(*b*), even in the vacuum pump 600, 700 of the same mechanism, the length and width of the rotating blades 606, 706 are different, and the number of stages in which the rotating blades 606, 706 are disposed is also different, so that the shape of the rotor 601, 701 is different.

For example, if the rotating blade 606, 706 is long, stress concentration is accordingly liable to occur. Therefore, the thickness of the rotor 601, 701 in a location where the stage of the long rotating blade 606, 706 is disposed increases accordingly. Inversely, the thickness of the rotor 601, 701 in a location where the stage of a short rotating blade 606, 706 is disposed is decreased as compared with the thickness of the rotor 601, 701 in the location where the stage of the long rotating blade 606, 706 is disposed considering the weight of the rotor 601, 701 rather than the stress concentration.

The reason why the bore of the pump case 609, 709 is substantially regulated is that the rotating blades 606, 706 can be contained according to the length of the rotating blade 606, 706. Also, the reason why the size of the base 602*b*, 702*b* is substantially regulated is that the pump case 609, 709 regulated according to the lengths of the rotating blades 606, 706 is supported.

Therefore, as shown in FIGS. 8(*a*) and 8(*b*), even in the vacuum pump 600, 700 of the same mechanism, the length and width of the rotating blades 606, 706 are different, and the number of stages in which the rotating blades 606, 706 are disposed is also different, so that the size of the base 602*b*, 702*b* is different.

In the above-described vacuum pump 600, 700, the bore of the pump case 609, 709 is substantially regulated, and the size of the base 602*b*, 702*b* that supports the lower side of the pump case 609, 709 is also substantially regulated. Also, in the vacuum pump 600, 700, the shape of the rotor 601, 701 is substantially regulated. Also, since the rotor 601, 701 is placed as close as possible to the stator column 602*a*, 702*a*, the shape of the outer peripheral surface of the stator column 602*a*, 702*a* is almost the same as the shape of the inner peripheral surface of the rotor 601, 701, and thus the shape of the outer peripheral surface of the stator column 602*a*, 702*a* is substantially regulated. Also, in the vacuum pump 600, 700, the length and width of the rotating blades 606, 706 provided in multiple stages are different in each stage.

Thus, each component constituting the vacuum pump 600, 700 is manufactured individually into a different shape according to the vacuum pump 600, 700.

Patent Document 1: Japanese Patent Laid-Open No. 2003-184785 (FIG. 5)

Patent Document 2: Japanese Patent No. 3084622 (page 2, FIG. 6)

DISCLOSURE OF THE INVENTION

Problems to be Solved by the Invention

As described above, in the conventional vacuum pump, the cooling water pipe is arranged on the outside of the vacuum pump, on the lower surface of the stator column, and on the outside of the base. Therefore, the conventional vacuum pump has a problem in that the cooling effect is difficult to reach the electrical equipment section that must be cooled, especially the drive motor.

If the cooling effect does not reach the electrical equipment section efficiently, the electrical equipment section has a danger of burning and destruction. Also, if the cooling effect reaches the electrical equipment section from the outside of the vacuum pump, the lower surface of the stator column, or the outside of the base, the gas flow path is also cooled, so that gas molecules are deposited in the vacuum pump. Therefore, there is a danger that the deposits come into contact with the rotor, and hence the vacuum pump is damaged.

Accordingly, one object of the present invention is to provide a vacuum pump in which the electrical equipment section for rotating the rotor is cooled efficiently, in proper temperature.

Also, in the conventional vacuum pump, since the length and width of the rotating blades and further the number of stages are different from vacuum pump to vacuum pump, and also the rotor whose shape is substantially regulated because the length and width of the rotating blades and further the number of stages are different is cooled, each component has been manufactured individually into a different shape according to the vacuum pump.

If each component is manufactured individually into a different shape according to the vacuum pump, a very high cost is required for manufacture and inventory management. In addition, there is a fear that the vacuum pump after being assembled gets into trouble inherent in that vacuum pump, so that it takes much time to identify the trouble.

Accordingly, another object of the present invention is to provide plural types of vacuum pumps capable of using common vacuum pump components even for a vacuum pump having a different size and shape though having the same structure, and to make the vacuum pump components common.

Means for Solving the Problems

The vacuum pump in accordance with a first example of the invention for solving one of the problems with the above-described conventional art is a vacuum pump which generates vacuum by rotating a rotor to suck and discharge a gas, characterized by including an electrical equipment section for rotating the rotor; a stator column containing the electrical equipment section; a base formed integrally with the stator column; and a cooling water pipe buried in the wall of the stator column, and provided with a branched water inlet port and a branched water outlet port.

In this invention, the term "electrical equipment section" means a drive motor for rotating at least the rotor. The electrical equipment section generates power when the vacuum pump is mechanically operated. Also, in the case where the bearing mechanism is a magnetic bearing, the magnetic bearing is also included in the electrical equipment section because an electromagnet is arranged, and a magnetic field is produced by electric power to hold the rotor.

The phrase "the wall of the stator column" means a thick portion of the wall having a predetermined thickness, which forms the stator column.

The phrase "branched" means that the inlet port and outlet port of the cooling water pipe are respectively divided into a plurality of cooling water pipes, and all of the plurality of cooling water pipes have a function of allowing a refrigerant water to flow.

By the above-described configuration, the cooling water pipe is provided just near the electrical equipment arranged near the center of the vacuum pump. Therefore, only the electrical equipment is cooled locally and hence the cooling effect becomes excellent. Also, since cooling is not transmitted via other members, a danger of depositing gas molecules in the vacuum pump becomes reduced.

Further, in the present invention, the water supply port and the water drain port of the cooling water pipe are allowed to communicate with outside in different directions. If the cooling water pipe is buried in the stator column, the locations of the water supply port and the water drain port of the cooling water pipe are regulated by the regulation of the arrangement position and the arrangement direction of the stator column. In the present invention, however, the user can select and use one branch convenient for using, from plural branches of cooling water pipe extended in different directions. For the vacuum pump configured as described above, the user need not rack his/her brains over the layout of the outer pipes for the vacuum pump, and the vacuum pump is easy to use. In addition, the vacuum pump in which the cooling water pipe is buried in the stator column is available for practical use in any equipment state.

Also, the vacuum pump in accordance with the present invention may be configured so that each of the water inlet port and the water outlet port are branched into two branches and disposed in the base, one branch of the water inlet port and one branch of the water outlet port being communicated with the outside of the vacuum pump at the side surface of the base, and the others with the outside of the vacuum pump at the bottom surface of the base.

Herein, the phrase "one branch" means one of two branched inlet port or outlet port of cooling water pipes.

By the above-described configuration, the water supply port and the water drain port of the cooling water pipe each can be allowed to communicate with the side and the bottom of the vacuum pump. Therefore, depending on the installation state of semiconductor manufacturing apparatus, even if the water supply port and the water drain port in the side surface cannot be used, the outer pipe can be connected to the bottom surface. Therefore, the user need not rack his/her brains over the layout of the outer pipes, and the vacuum pump is easy to use. In addition, the vacuum pump in which the cooling water pipe is buried in the stator column is available for practical use in any equipment state.

Also, the vacuum pump in accordance with the present invention is a vacuum pump which generates vacuum by rotating the rotor to suck and discharge a gas, characterized by including an electrical equipment section for rotating the rotor; a stator column containing the electrical equipment section; a base formed integrally with the stator column; a cooling water pipe buried in the wall of the stator column; and a plurality of joints which are fixed to each ends of the cooling water pipe and buried in the vacuum pump flush with the external surface of the pump.

By the above-described configuration, the cooling water pipe can be provided just near the electrical equipment section arranged near the center of the vacuum pump. Therefore, only the electrical equipment section is cooled locally and hence the cooling effect is excellent. Also, since cooling is not transmitted via other members, a danger of depositing gas molecules in the vacuum pump can be reduced.

Further, since the cooling water pipe does not project to the outside of the vacuum pump, at the time of laying the piping, there is no fear that the cooling water pipe is distorted, the position of the stator column is shifted, or the stator column is damaged. Therefore, the cooling capacity of the cooling water pipe can be maintained, and also the life of the vacuum pump is increased.

Also, in the vacuum pump in accordance with the present invention, the joint and the cooling water pipe may be formed of the same metal.

In the above-described configuration, there is no potential difference between the joint and the cooling water pipe. Therefore, even if a refrigerant is allowed to flow, no current flows, and hence corrosion does not occur, so that the cooling capacity of the cooling water pipe can be maintained, and also the life of the vacuum pump is increased.

The vacuum pump in accordance with a second invention for solving another one of the problems with the above-described conventional art is a vacuum pump which generates vacuum by sucking and discharging a gas, characterized by including a pump case for the vacuum pump; a thread pump stator for supporting the pump case; a base for supporting the thread pump stator; a stator column formed integrally with the base; a rotor arranged so as to cover the stator column; rotating blades provided in multiple stages at the outer periphery of the rotor; and a cooling water pipe buried in the wall of the stator column.

Herein, the term "thread pump stator" means a stator interacting with the rotor. The thread pump stator functions as a thread groove pump by means of the interaction with the rotor. In this case, it is a matter of course that a thread groove is formed. The thread groove may be formed on the thread pump stator side or on the rotor side.

Herein, the phrase "the wall of the stator column" means a thick portion of the wall having a predetermined thickness, which forms the stator column.

Herein, the phrase "arranged so as to cover" means that the stator column lies on the inner peripheral surface side of the rotor. The distance between the inner peripheral surface of the rotor and the outer peripheral surface of the stator column is not a concern. Therefore, the stator column has only to face to the inner peripheral surface side of the rotor regardless of the size of the stator column.

Also, the pump case may have a fastening portion which is fastened to the thread pump stator to support the pump case, and the thread pump stator may have a flange which extends from the thread pump stator and fastens the pump case to support the pump case.

Also, the external casing of the vacuum pump may be formed by the pump case, the thread pump stator, and the base.

Also, in the vacuum pump in accordance with the present invention, the inner peripheral surface shape of the rotor and the outer peripheral surface shape of the stator column may be different from each other.

By the above-described configuration, even in the vacuum pumps of plural types each having a different size and shape due to the difference in required performance though having the same structure, the base and the stator column that have been made common can be made a vacuum pump component regardless of the shape of rotor and the bore of pump case, so that the cost required for manufacture and inventory management can be saved. In addition, a problem of inherent trouble is reduced, and even if a trouble occurs, the time required for identifying the trouble can be saved.

Also, the vacuum pump in accordance with the present invention may further include a cooling water pipe arranged on the outer surface of the thread pump stator.

By the above-described configuration, the stator column can further be made common regardless of the difference in rotor shape. Therefore, the cost required for manufacture and inventory management can be saved, and also a problem of inherent trouble is reduced and even if a trouble occurs, the time required for identifying the trouble can be saved. In addition, the rise in temperatures of the rotor and the rotating blades can be inhibited surely.

Also, the vacuum pump in accordance with the present invention may further include a heater arranged on the outer surface of the thread pump stator.

By the above-described configuration, the gas flow path having the function of a thread groove pump can be warmed, so that the production of gas deposits is prevented, and hence the reliability of the vacuum pump can be improved.

Effects of the Invention

As described above, the vacuum pump of the first invention is provided with a electrical equipment section for rotating the rotor, a cooling water pipe buried in the wall of a stator column formed integrally with a base, and a water supply port and a water drain port of the cooling water pipe respectively branched into plural branches. Therefore, the cooling water pipe is disposed just near the electrical equipment section near the center of the vacuum pump, so that only the electrical equipment section is cooled locally and hence the cooling effect is excellent. Also, a danger of depositing gas molecules in the vacuum pump is reduced, and further the water supply port and the water drain port of the cooling water pipe are allowed to communicate with outside in their required different directions. Therefore, the user can select and use one branch convenient for using, from plural branches of cooling water pipe extended in different directions, and the user need not rack his/her brains over the layout of the outer pipes for the vacuum pump, and the vacuum pump is easy to use. In addition, the vacuum pump in which the cooling water pipe is buried in the stator column is available for practical use in any the equipment state.

Also, in the vacuum pump in accordance with the present invention, the water supply port and the water drain port of the cooling water pipe each are branched into two branches and extendedly provided in the base; and one of the branched water supply port communicates with the outside of the vacuum pump from the side surface of the base, and the other thereof communicates with the outside of the vacuum pump from the bottom surface of the base, and the water drain port is configured similarly. Therefore, even if the water supply port and the water drain port on the side surface cannot be used depending on the installation state of semiconductor manufacturing apparatus, outer pipes can be connected to the bottom surface, so that the user need not rack his/her brains over the layout of the outer pipes, and the vacuum pump is easy to use. In addition, the vacuum pump in which the cooling water pipe is buried in the stator column is available for practical use in any equipment state.

In the vacuum pump in accordance with the present invention, the joints are respectively fixed at ends of cooling water pipe, and buriedly provided so that the outer end of the joint is flush with the external surface of the vacuum pump. Therefore, at the time of laying the piping, there is no fear that the cooling water pipe is distorted, the position of the stator column is shifted, or the stator column is damaged, so that the cooling capacity of the cooling water pipe can be maintained, and also the life of the vacuum pump is increased.

Also, in the vacuum pump in accordance with the present invention, the joint and the cooling water pipe are formed of the same metal. Therefore, there is no potential difference between the joint and the cooling water pipe, so that even if a refrigerant is allowed to flow, no current flows, and hence corrosion does not occur. Thereby, the cooling capacity of the cooling water pipe can be maintained, and also the life of the vacuum pump is increased.

In the vacuum pump of the second invention, the pump case is supported by the flange of the thread pump stator, and the cooling water pipe is buried in the wall of the stator column. Therefore, even in the vacuum pumps of plural types each having a different size and shape due to the difference in required performance though having the same structure, the base and the stator column that have been made common can be made a vacuum pump component regardless of the shape of rotor and the bore of pump case, so that the cost required for manufacture and inventory management can be saved. In addition, a problem of inherent trouble is reduced, and even if a trouble occurs, the time required for identifying the trouble can be saved.

Also, in the vacuum pump in accordance with the present invention, the cooling water pipe is installed on the outer surface of the thread pump stator supporting the pump case. Therefore, the stator column can further be made common regardless of the difference in rotor shape, so that the cost required for manufacture and inventory management can be saved, and also a problem of inherent trouble is reduced and even if a trouble occurs, the time required for identifying the trouble can be saved. In addition, the rise in temperatures of the rotor and the rotating blades is surely inhibited.

Also, in the vacuum pump in accordance with the present invention, the heater is installed on the outer surface of the thread pump stator supporting the pump case. Therefore, the thread pump stator having the thread groove, which is a gas flow path in which gas deposits are liable to accumulate, can be warmed directly. Therefore, the production of gas deposits is prevented, and hence the reliability of the vacuum pump can be improved.

BEST MODE FOR CARRYING OUT THE INVENTION

A preferred embodiment of a vacuum pump in accordance with a first example of the invention will now be described in detail with reference to FIGS. 1 to 3.

FIG. 1 is a sectional view of a vacuum pump in accordance with the present invention, FIG. 2 is a horizontal sectional view of a vacuum pump in accordance with the present invention, being at a position where a cooling water pipe is buried in a stator column, and FIG. 3 is an enlarged sectional view of an end of a cooling water pipe of the vacuum pump in accordance with the present invention.

EXAMPLE 1

A vacuum pump 100 in accordance with the present invention, shown in FIG. 1, is a composite pump of a turbo-molecular pump and a thread groove pump.

In a pump case 109 of the vacuum pump 100, there is arranged a stator column 102*a* containing an electrical equipment section consisting of a drive motor 103*a* and magnetic bearings 103*b*. On the bottom surface of the stator column 102*a*, a base 102*b* is formed integrally with the stator column 102*a* and extends in the horizontal direction. In the stator column 102*a*, a rotor shaft 101*a* is arranged, the rotor shaft 101*a* projecting from an upper part of the stator column 102*a*. To an end portion of the rotor shaft 101*a*, a rotor 101 is fastened.

The rotor shaft 101*a* is held rotatably by the magnetic bearings 103*b*, and is rotated by the drive motor 103*a*. Therefore, since the rotor shaft 101*a* is held rotatably and rotated, the rotor 101 is rotated by the electrical equipment section consisting of the drive motor 103*a* and the magnetic bearings 103*b*.

The rotor 101 has a cross-sectional shape such as to cover the outer periphery of the stator column 102*a*, and at the upper outer periphery of the rotor 101, rotating blades 106 are arranged in multiple stages. Also, stationary blades 107 are arranged in multiple stages so as to abut on the inner peripheral surface of the pump case 109. The rotating blades 106 and the stationary blades 107 are arranged alternately. Further, under the stationary blade 107 in the lowest stage, a thread stator 108 is arranged so as to abut on the inner peripheral surface of the pump case 109, and in the inner peripheral surface of the thread stator 108, a thread groove 108*a* is formed.

Gas transfer means is formed by the inner peripheral surface of the above-described rotor 101, the rotating blades 106, the stationary blades 107, and the thread groove 108*a*, and also gas molecules flow in a clearance between the inner peripheral surface of the above-described rotor 101, the rotating blades 106, the stationary blades 107, and the thread groove 108*a*, forming a gas flow path.

Also, the stator column 102*a* is cast by a casting, and in the wall of the stator column 102*a*, namely, in a thick portion of wall forming the stator column 102*a*, a cooling water pipe 104 is buried by casting. The cooling water pipe 104 is formed, for example, of a stainless steel, and is cast. As shown in FIG. 2, the cooling water pipe 104 is buried so as to make a round near the drive motor 103*a*, and both end sides thereof are extended from the stator column 102*a* to the base 102*b* side, and communicate with the outside of the vacuum pump 100 as a water supply port 104*a* and a water drain port 104*b*. At this time, since the base 102*b* extends integrally from the lower surface of the stator column 102*a*, there is no need for burying the cooling water pipe 104 separately in the stator column 102*a* portion and in the base 102*b* portion and for aligning the openings of the cooling water pipes 104. Also, needless to say, in this embodiment, the cooling water pipe 104 may make a plurality of rounds in the wall of the stator column 102*a* so as to be brought close to an electrical equipment section other than the drive motor 103*a*.

The cooling water pipe 104 is buried in the wall of the stator column 102*a*, so that the cooling water pipe 104 can be provided just near the electrical equipment section arranged in the vicinity of the center of the vacuum pump 100. Therefore, only the electrical equipment section is cooled locally, and there is no need for propagating the cooling effect via other parts.

The cooling water pipe 104 extended to the base 102*b* communicates with the outside of the vacuum pump 100 with one end being the water supply port 104*a* and the other end being the water drain port 104*b*. As shown in FIG. 3, before the cooling water pipe 104 communicates with the outside of the vacuum pump 100, each of the water supply port 104*a* and the water drain port 104*b* is branched into a plurality of branches. In this embodiment, each of the water supply port 104*a* and the water drain port 104*b* is branched into two branches, so that the cooling water pipe 104 communicates with the outside of the vacuum pump 100, by way of the branch of the water supply port 104*a*. In the case of this embodiment, one of the branches of the water supply port 104*a* is facing to the side surface of the base 102*b* and the other to the bottom surface of the base 102*b*, enabling communication with the outside of the vacuum pump 100 from either the side surface of the base 102*b* or the bottom surface of the base 102*b*. Similarly, the water drain port 104*b* of the cooling water pipe 104 branched into two branches, one of the branches of the water drain port 104*b* facing to the side surface of the base 102*b* and the other to the bottom surface of the base 102*b*.

In this embodiment, both ends of the cooling water pipe 104 communicate with the outside of the vacuum pump 100 on the side opposite to an electrical outlet 110. However, both ends of the cooling water pipe 104 may communicate with the outside of the vacuum pump 100 at both sides of the electrical outlet 110.

In case that each of both the ends of the cooling water pipe 104 is respectively branched into a plurality of branches, the branches of the water supply port 104*a* or the water drain port 104*b* may respectively communicate with the outside of the vacuum pump 100 in different directions to each other. Therefore, the user can use a branch convenient for using, and thereby the vacuum pump 100, in which the cooling water pipe 104 is buried in the stator column 102*a*, is available for practical use in any semiconductor manufacturing plant.

Outer piping can be easily connected with the vacuum pump 100 by way of the port branches of the cooling water pipe 104 on the bottom surface, even if the water supply port 104*a* branch and the water drain port 104*b* branch on the side surface cannot be used depending on the installation state of semiconductor manufacturing plant, so that the vacuum pump 100 is available for practical use in any equipment state. Because, the cooling water pipe 104 has water supply port 104*a* and the water drain port 104*b*, each of the ports being branched into two branches and communicating with outside by way of branches, one of the branches in the supply port 104*a* directed and facing to the side surface of the base 102*b* and the other to the bottom surface of the base 102*b*, similarly, one of the branches in the drain port 104*b* directed and facing to the side surface of the base 102*b* and the other to the bottom surface of the base 102*b*.

Further, as shown in FIG. 3, at each of the two branches of the both ends of the cooling water pipe 104, a joint 105 is respectively fixed by welding. This joint 105 is buried in the base 102*b* so that the outside end of the joint 105 and the outer surface of the base 102*b* are flush with each other. The cooling water pipe 104 and the joint 105 are formed of the same metal. If the cooling water pipe 104 is formed of a stainless steel, the joint 105 is also formed of the stainless steel.

As described above, the joint 105 is fixed at the ends of the cooling water pipe 104, and the joints 105 are buried so that the outside end of the joint 105 and the external surface of the vacuum pump 100 such as the base 102*b* are flush with each other. Therefore, the cooling water pipe 104 does not project to the outside of the vacuum pump 100, and at cooling water pipe setting, there is no fear of any warping or setting error of the cooling water pipe 104, or any damage on the stator column 102*a*.

Also, if the joint 105 and the cooling water pipe 104 are formed of the same metal, there is no potential difference between the joint 105 and the cooling water pipe 104. Therefore, even if a refrigerant is allowed to flow, no current flows, and hence corrosion does not occur.

The vacuum pump 100 in accordance with this embodiment is configured as described above, and cooling water or a refrigerant, such as a liquid or a gas, having a strong heat exchanging action is allowed to flow in the cooling water pipe 104 to cool the nearby electrical equipment section with other parts scarcely lying between the cooling water pipe 104 and the electrical equipment section. Also, each of the water supply port 104*a* and the water drain port 104*b* branches into two sections and communicates with the outside of the vacuum pump 100 from the side surface and bottom surface of the base 102*b*, so that one port of the two sections is connected to an outer pipe via the joint 105 by the user's selection.

The installation of the vacuum pump 100 having the above-described configuration of this embodiment will be explained. First, the vacuum pump 100 is fixed in a hollow state in the process chamber of semiconductor manufacturing apparatus, not shown, by a flange provided in an upper part of the pump case 109. After the vacuum pump 100 has been fixed, the outer pipe for supplying refrigerant is connected to the port of the branched cooling water pipe 104, which communicates with the outside of the vacuum pump 100 from the side surface of the base 102*b*.

However, when the vacuum pump 100 is fixed in the process chamber, the arrangement position and arrangement direction of the stator column 102*a* is regulated automatically. At the same time, if the cooling water pipe 104 is buried in the stator column 102*a*, the arrangement position and arrangement direction of the stator column 102*a* is regulated. Thereby, the arrangement positions and arrangement directions of the water supply port 104*a* and the water drain port 104*b* of the cooling water pipe 104 are also regulated. Depending on the installation state of semiconductor manufacturing apparatus, the port of the branched cooling water pipe 104, which communicates with the outside of the vacuum pump 100 from the side surface of the base 102*b* is hidden behind the equipment, or lies on the side opposite to the arrangement position of the outer pipe, so that, in some cases, the outer pipe cannot be connected to the port. If an attempt is made to forcibly connect the outer pipe, the cooling water pipe 104 is damaged by the tensile force etc. of the outer pipe, or the position of the stator column 102*a* is shifted, and in the worst case, a failure of the vacuum pump 100 is caused.

In such a case, the outer pipe is connected to the port of the branched cooling water pipe 104, which communicates with the outside of the vacuum pump 100 from the bottom surface of the base 102*b*. At the time of connection, the outer pipe is inserted and fixed in the joint 105, by which the connection is completed. At this time, since the joint 105 is buried so as to be flush with the outer surface of the base 102*b*, the tensile force of the outer pipe, a force applied by the user, and the like are not applied to the end of the cooling water pipe 104, so that there is no fear that the cooling water pipe 104 gets twisted. After the connection has been completed, the other port that has not been connected is covered with a lid, by which the installation of the vacuum pump 100 is completed.

Thus, the outer pipe can be connected to the vacuum pump 100 by appropriately selecting the side surface or the bottom surface according to the installation state of semiconductor manufacturing apparatus.

Next, the operation of the vacuum pump 100 having the above-described configuration of this embodiment will be explained. First, when the drive motor 103*a* is driven, the rotor shaft 101*a*, the rotor 101 fastened to the rotor shaft 101*a*, and the rotating blades 106 are rotated at a high speed.

The rotating blade 106 in the uppermost stage, which is rotating at a high speed, gives a downward momentum to the introduced gas molecules. The gas molecules having this downward momentum are sent to the rotating blade 106 side in the next stage by the stationary blade 107. The above operation in which the momentum is given to the gas molecules and the gas molecules are sent is repeated in multiple stages, by which the gas molecules are transferred in succession to the thread groove 108*a* side and are discharged. Further, the gas molecules reaching the thread groove 108*a* side by means of the molecule exhaust operation are compressed and transferred to the exhaust side by the interaction between the rotation of the rotor 101 and the thread groove 108*a*, and are discharged.

In the above-described operation of the vacuum pump 100, in particular, the working of the cooling water pipe 104 buried in the stator column 102*a* is explained.

First, when the gas in the process chamber begins to be drawn, electric power is supplied to the electrical equipment section, such as the drive motor 103*a* and the magnetic bearings 103*b*, of the vacuum pump 100 in accordance with the present invention. When the electric power is supplied to the electrical equipment section, the rotor 101 is rotatably held by the magnetic bearings 103*b* via the rotor shaft 101*a*, and, at the same time, is rotated by the drive motor 103*a* via the rotor shaft 101*a*.

The electrical equipment section, such as the drive motor 103*a* and the magnetic bearings 103*b*, rotates the rotor 101 at several ten thousand r.p.m until a vacuum is generated in the process chamber, and soon begins to generate heat. At the same time, a refrigerant is allowed to flow in the cooling water pipe 104 through the outer pipe. The cooling water pipe 104 buried in the stator column 102*a* begins to achieve the cooling effect. The refrigerant flowing in the cooling water pipe 104 acts so as to mainly cool the nearby electrical equipment section and absorb heat. Specifically, since the cooling water pipe 104 is buried in the wall of the stator column 102*a*, the cooling effect of the cooling water pipe 104 propagates in the stator column 102*a* and acts so as to cool the nearby electrical equipment section. Therefore, the cooling water pipe 104 has only to have cooling capacity enough to cool the nearby electrical equipment section, and the cooling effect is not transmitted to the base 102*b* and the thread stator 108 through the stator column 102*a*. As a result, the electrical equipment section maintains a stable temperature without temperature rise caused by heat generation of the electrical equipment section itself, the cooling effect is less prone to propagate to other members, and gas molecules are less prone to be deposited by the cooling effect of the cooling water pipe 104.

Next, preferred embodiments of vacuum pumps 200, 300 and 400 in accordance with a second example of the invention will be described in detail with reference to FIGS. 4 to 6.

FIGS. 4(*a*) and 4(*b*) are sectional views of vacuum pumps 200 and 300 in accordance with the second example, showing that even in the vacuum pumps having different performance, their components are made common. FIG. 5 is a horizontal sectional view of a vacuum pump 200 or 300 in accordance with the present invention, being at a position where a cooling water pipe 204 is buried in a stator column 202*a*. FIG. 6 is a sectional view showing a state in which a (second) cooling water pipe 204A and a heater 411 are installed to a thread pump stator of the vacuum pump in accordance with the second invention of the present invention.

EXAMPLE 2

The vacuum pumps 200 and 300 in accordance with this embodiment, shown in FIGS. 4(*a*) and 4(*b*), are composite pumps in which a turbo-molecular pump and a thread groove (208*a* or 308*a*) pump are compounded.

For this vacuum pump 200 or 300, an external casing is formed by a pump case 209 or 309, a thread pump stator 208 or 308 supporting the pump case 209, 309, and a base 202*b* supporting the thread pump stator 208, 308. The thread pump stator 208, 308 is erected at a fixed position in an upper surface edge portion of the base 202*b*, and is supported by the base 202*b*. The pump case 209, 309 is provided with a fastening portion 209*a*, 309*a* at the lower edge thereof, and on the other hand, the thread pump stator 208, 308 is extendedly provided so that a flange 208*b*, 308*b* projects from the upper edge thereof, and the flange 208*b*, 308*b* is extended to the fastening portion 209*a*, 309*a*.

In some vacuum pump, the fastening portion of the pump case is not present above the thread pump stator because the thread pump stator is erected at the fixed position of the base. In this vacuum pump 200, 300, however, since the flange 208*b*, 308*b* is extended to the fastening portion 209*a*, 309*a*, even if the thread pump stator 208, 308 is erected at the fixed position of the base 202*b*, the flange 208*b*, 308*b* and the fastening portion 209*a*, 309*a* can be fastened to each other, so that the pump case 209, 309 is supported by the thread pump stator 208, 308.

On the upper surface of the base 202*b*, a substantially cylindrical stator column 202*a* is formed integrally, and in the stator column 202*a*, a bearing mechanism and a drive motor are contained. Also, in the stator column 202*a*, a rotor shaft 201*a*, 301*a* is arranged. The rotor shaft 201*a*, 301*a* projects from an upper part of the stator column 202*a*.

To an end portion of the rotor shaft 201*a*, 301*a*, a rotor 201, 301 is fastened. This rotor 201, 301 has a shape such as to cover the stator column 202*a*. At the upper outer periphery of the rotor 201, 301, rotating blades 206, 306 are arranged in multiple stages. Also, stationary blades 207, 307 are arranged in multiple stages so as to abut on the inner peripheral surface of the pump case 209, 309. The rotating blades 206, 306 and the stationary blades 207, 307 are arranged alternately.

At a position where the inner peripheral surface of the thread pump stator 208, 308 faces to the rotor 201, 301, a thread groove 208*a*, 308*a* is formed. Depending on the embodiment, the thread groove may be formed at a position where the thread pump stator 208, 308, not the inner peripheral surface of the thread pump stator 208, 308, faces to the rotor 201, 301.

The stator column 202*a* is a casting cast integrally with the base 202*b*, and in the wall surface of the stator column 202*a*, namely, in a thick portion of wall forming the stator column 202*a*, a cooling water pipe 204 is buried by casting.

As shown in FIG. 5, the cooling water pipe 204 is buried so as to make a round around the stator column 202*a*, and both ends thereof are extended to the base 202*b*, and communicate with the outside of the vacuum pump 200, 300 from the outer surface of the base 202*b* with one end being a water supply port 204*a* and the other end being a water drain port 204*b*.

In the above-described vacuum pump 200, 300, gas transfer means is formed by the outer peripheral surface of the rotor 201, 301, the rotating blades 206, 306, the stationary blades 207, 307, and the thread groove 208*a*, 308*a*, and also gas molecules flow in a clearance between the outer peripheral surface of the rotor 201, 301, the rotating blades 206, 306, the stationary blades 207, 307, and the thread groove 208*a*, 308*a*, forming a gas flow path.

Next, the operation of the vacuum pump 200, 300 having the above-described configuration of this embodiment will be explained. First, when the drive motor is driven, the rotor shaft 201*a*, 301*a*, the rotor 201, 301 fastened to the rotor shaft 201*a*, 301*a*, and the rotating blades 206, 306 are rotated at a high speed.

The rotating blade 206, 306 in the uppermost stage, which is rotating at a high speed, gives a downward momentum to the introduced gas molecules. The gas molecules having this downward momentum are sent to the rotating blade 206, 306 side in the next stage by the stationary blade 207, 307. The above operation in which the momentum is given to the gas molecules and the gas molecules are sent is repeated in multiple stages, by which the gas molecules are transferred in succession to the thread groove 208*a*, 308*a* side and are discharged. Further, the gas molecules reaching the thread groove 208*a*, 308*a* side by means of the molecule exhaust operation are compressed and transferred to the exhaust side by the interaction between the rotation of the rotor 201, 301 and the thread groove 208*a*, 308*a*, and are discharged.

As described above, the vacuum pumps 200 and 300 of this embodiment as shown in FIGS. 4(*a*) and 4(*b*) have the same configuration and the same operation and function, but have a different shape as shown in FIGS. 4(*a*) and 4(*b*).

Specifically, the lengths of the rotating blades of the vacuum pump 300 shown in FIG. 4(*b*) are longer than those of the vacuum pump 200 shown in FIG. 4(*a*). The number of stages of the rotating blades is nine in the vacuum pump 200 shown in FIG. 4(*a*), whereas the number of stages of the rotating blades is small, being seven, in the vacuum pump 300 shown in FIG. 4(*b*)

The reason for a difference in the rotating blades 206, 306 between the vacuum pumps 200 and 300 shown in FIGS. 4(*a*) and 4(*b*) is that the required performance differs between the vacuum pumps 200 and 300 shown in FIGS. 4(*a*) and 4(*b*).

Also, the bore of the pump case of the vacuum pump 300 shown in FIG. 4(*b*) is larger than that of the vacuum pump 200 shown in FIG. 4(*a*). This difference in bore between the pump cases 209 and 309 is caused by a difference in length between the rotating blades 206 and 306.

Also, the shape of the rotor 201, 301, especially the inner peripheral surface shape thereof, differs between the vacuum pump 200 shown in FIG. 4(*a*) and the vacuum pump 300 shown in FIG. 4(*b*). This difference in shape between the rotors 201 and 301 is caused by a difference in length and number of stages between the rotating blades 206 and 306.

Thus, in the vacuum pumps 200 and 300 shown in FIGS. 4(*a*) and 4(*b*), since the required performance is different, the pump cases 209, 309, the lengths and the number of stages of the rotating blades 206, 306, and the shape of the rotors 201, 301 differ from each other.

However, in the vacuum pumps 200 and 300 shown in FIGS. 4(*a*) and 4(*b*), although the pump cases 209, 309, the lengths and the number of stages of the rotating blades 206, 306, and the shape of the rotors 201, 301 differ from each other, the base 202*b* and the stator column 202*a* formed integrally with the base 202*b* have the same shape and the same size. In other words, the base 202*b* and the stator column 202*a* formed integrally with the base 202*b* are common in the vacuum pump 200 and 300 shown in FIGS. 4(*a*) and 4(*b*).

Hereunder is explained the reason why the base 202*b* and the stator column 202*a* formed integrally with the base 202*b* may be common in the vacuum pumps 200 and 300 shown in FIGS. 4(*a*) and 4(*b*) although the pump cases 209, 309, the lengths and the number of stages of the rotating blades 206, 306, and the shape of the rotors 201, 301 differ in the vacuum pumps 200 and 300 shown in FIGS. 4(*a*) and 4(*b*)

In the vacuum pumps 200, 300 of this embodiment, as described above, the cooling water pipe 204 is buried in the wall of the stator column 202*a*. Cooling water or a refrigerant, such as a liquid or a gas, having a strong heat exchanging action is allowed to flow in the cooling water pipe 204 through the water supply port 204*a*, and is drained through the water drain port 204*b*.

When the cooling water pipe 204 begins to achieve the cooling effect, since the cooling water pipe 204 is buried in the stator column 202*a*, all of the cooling effect is first propagated in the stator column 202*a*. Therefore, the stator column 202*a* is cooled sufficiently.

The sufficiently cooled stator column 202*a* can sufficiently absorb heat of vacuum pump components separated to some extent. Specifically, the sufficiently cooled stator column 202*a* can sufficiently absorb heat of the rotor 201, 301 and the rotating blades 206, 306 even if the rotor 201, 301 is separated to some extent from the stator column 202*a*, so that rise in temperatures of the rotor 201, 301 and the rotating blades 206, 306 is depressed.

In case that the rotor 201, 301 is separated to some extent from the stator column 202*a*, the outer peripheral surface shape of the stator column 202*a* is not regulated so as to match the inner peripheral surface shape of the rotor 201, 301. Therefore, even in the vacuum pumps 200, 300 in which the shape of the rotors 201, 301 are different to each other, shown in FIGS. 4(*a*) and 4(*b*), the stator column 202*a* can be designed freely, and the stator column 202*a* can be made common in size and shape.

The cooling water pipe 204 being buried in the stator column 202*a* in this manner, for effective cooling, the outer peripheral surface shape of the stator column 202*a* does not need any regulation by the inner peripheral surface shapes of the rotors 201, 301. Therefore, a common stator column 202*a* may be used even in the vacuum pumps 200 and 300 which have the same configuration and the same operation and function but have a different shape.

Also, as described above, the vacuum pump 200, 300 of this embodiment is provided with the thread pump stator 208, 308 which supports the pump case 209, 309 and is supported by the base 202*b*. Of the pump case 209, 309, the thread pump stator 208, 308, and the base 202*b*, the external casing consists. That is to say, the pump case 209, 309 and the base 202*a* are fastened to each other via the thread pump stator 208, 308.

The base 202*b* is configured so that the thread pump stator 208, 308 is erected at the fixed position on the upper surface of the base 202*b* and is supported.

The thread pump stator 208, 308 erected at the fixed position of the base 202*b* supports the pump case 209, 309 by fastening the fastening portion 209*a*, 309*a* of the pump case 209, 309 to the flange 208*b*, 308*b* of the thread pump stator 208, 308. The bores of the pump cases are different from each other.

Therefore, to fasten the fastening portion 209*a*, 309*a* of the pump case 209, 309 to the flange 208*b*, 308*b* of the thread pump stator 208, 308, the thread pump stator 208, 308 is formed so that the flange 208*b*, 308*b* is extended a predetermined distance to the fastening portion 209*a*, 309*a* of the pump case 209, 309. Inversely, the fastening portion 209*a*, 309*a* of the pump case 209, 309 may be extended a predetermined distance to the flange 208*b*, 308*b* of the thread pump stator 208, 308.

By forming the thread pump stator 208, 308 so that the flange 208*b*, 308*b* is extended to the fastening portion 209*a*, 309*a* of the pump case 209, 309, the pump case 209, 309 can be supported by the thread pump stator 208, 308 even in the case where the thread pump stator 208, 308 is erected at the fixed position on the upper surface of the base 202*b*.

The base 202*b* supports the thread pump stator 208, 308 erected at the fixed position without supporting the pump case 209, 309, and further the flange 208*b*, 308*b* of the thread pump stator 208, 308 is adjustably formed by being extended a predetermined distance according to the pump case 209, 309, by which there is no need for regulating the size of the base 202*b* by being regulated by the bore of the pump case 209, 309.

Thereby, even in the vacuum pump in which the bore of the pump case 209, 309 is different, like the vacuum pumps 200 and 300 shown in FIGS. 4(*a*) and 4(*b*), the base 202*b* can be designed freely, and the base 202*b* can be made common in size and shape.

In case that the pump case 209, 309 is supported by the thread pump stator 208, 308 in this manner, the size of the base 202*b* is not regulated by the bore of the pump case 209, 309. Therefore, a common base 202*b* can be used even in the vacuum pumps which have the same configuration and the same operation and function but have a different shape.

As described above, despite the fact that the pump case 209, 309, the lengths and the number of stages of the rotating blades 206, 306 and the shape of the rotor 201, 301 are different, the base 202*b* and the stator column 202*a* formed integrally with the base 202*b* are made common.

The base 202*b* and the stator column 202*a* formed integrally with the base 202*b* that have been made common can be manufactured and controlled easily as one part, and the cost required for manufacture and inventory management can be saved. In addition, a problem of inherent trouble is reduced, and even if a trouble occurs, the time required for identifying the trouble can be saved.

In this embodiment, the base 202*b* and the stator column 202*a* are formed integrally. However, even if the base 202*b* and the stator column 202*a* are formed separately, these elements can be made common. The integration of the stator column 202*a* with the base 202*b* contributes to the reduction in cost. In addition, the integration eliminates the need for burying the cooling water pipe 204 separately in the stator column 202*a* portion and in the base 202*b* portion and for aligning the openings of the cooling water pipes 204.

By the above-described configuration, the vacuum pump 300 shown in FIG. 4(*b*) can use the base 202*b* and the stator column 202*a* formed integrally with the base 202*b* that are shown in FIG. 4(*a*) as a component although the vacuum pump 300 has long rotating blades 306, a small number of stages of the rotating blades 306, a large bore of the pump case 309, and the rotor 301 having a different shape as compared with the vacuum pump 200 shown in FIG. 4(*a*). In other words, the base 202*b* and the stator column 202*a* formed integrally with the base 202*b* can be made common.

EXAMPLE 3

The vacuum pump 400 in accordance with another embodiment of the second example of the invention will be described with reference to FIG. 6.

In FIG. 6, the vacuum pump 400 is further provided with a second cooling water pipe 204A and the heater 411, which are installed on the outer surface of a thread pump stator 408. The outer surface is exposed to the outside of the vacuum pump 400. The thread pump stator 408 functions as a part of the external casing. The second cooling water pipe 204A is another from the cooling water pipe 204 buried in the stator column 202*a*.

First, the case where the cooling water pipe 204A is installed on the outer surface of the thread pump stator 408 is explained.

The thread pump stator 408 faces to a rotor 401 like the stator column 202*a* because a thread groove 408*a* formed in the thread pump stator 408 and a gas flow path below the rotor 401 are provided. Specifically, the lower part of the rotor 401 is interposed between the stator column 202*a* and the thread pump stator 408.

The cooling water pipe 204A installed on the outer surface of the thread pump stator 408 achieves the cooling effect to cool the thread pump stator 408.

The cooled thread pump stator 408 absorbs heat of the facing rotor 401, and the cooled stator column 202*a* absorbs heat, by which the rise in temperatures of the rotor 401 and rotating blades 406 is inhibited.

Therefore, in the case where the cooling water pipe 204A is installed on the outer surface of the thread pump stator 408, the stator column 202*a* and the rotor 401 need not be further brought close to each other, so that the distance between the stator column 202*a* and the rotor 401 can further be increased. If the distance between the stator column 202*a* and the rotor 401 can further be increased, the stator column 202*a* can be designed freely regardless of the inner peripheral shape of the rotor 401, and hence the stator column 202*a* can further be made common.

Also, some semiconductor manufacturing process is a process in which gas molecules that have a high saturated vapor pressure and are less prone to change into a liquid or a gas flow in the vacuum pump 400. In this case, the lowering of the temperature in the vacuum pump 400 rather inhibits the rise in temperatures of the rotor 401 and the rotating blades 406. If the cooling water pipe 204A is installed on the outer surface of the thread pump stator 408, since the thread pump stator 408 is directly adjacent to the interior of the vacuum pump 400, the cooling effect in the vacuum pump 400 is enhanced, and hence the rise in temperatures of the rotor 401 and the rotating blades 406 can be inhibited surely.

Next, the case where the heater 411 is installed on the outer surface of the thread pump stator 408 is explained.

The heat produced by the heater 411 installed on the outer surface of the thread pump stator 408 warms the thread pump stator 408. Since the thread pump stator 408 is contiguous to the gas flow path, the warmed thread pump stator 408 radiates heat to warm the gas flow path.

In the gas flow path contiguous to the thread pump stator 408, a gas changing from an intermediate flow to a viscous flow is present, so that the saturated vapor pressure of gas is exceeded, and gas deposits are liable to accumulate. However, if the gas is warmed by the heat radiation from the thread pump stator 408, the saturated vapor pressure of gas rises, and hence the gas deposits do not accumulate. Therefore, there is no fear that the gas deposits come into contact with the rotor 401 and the vacuum pump 400 is destroyed, so that the reliability of the vacuum pump 400 can be improved.

DESCRIPTION OF SYMBOLS

Figure 1:
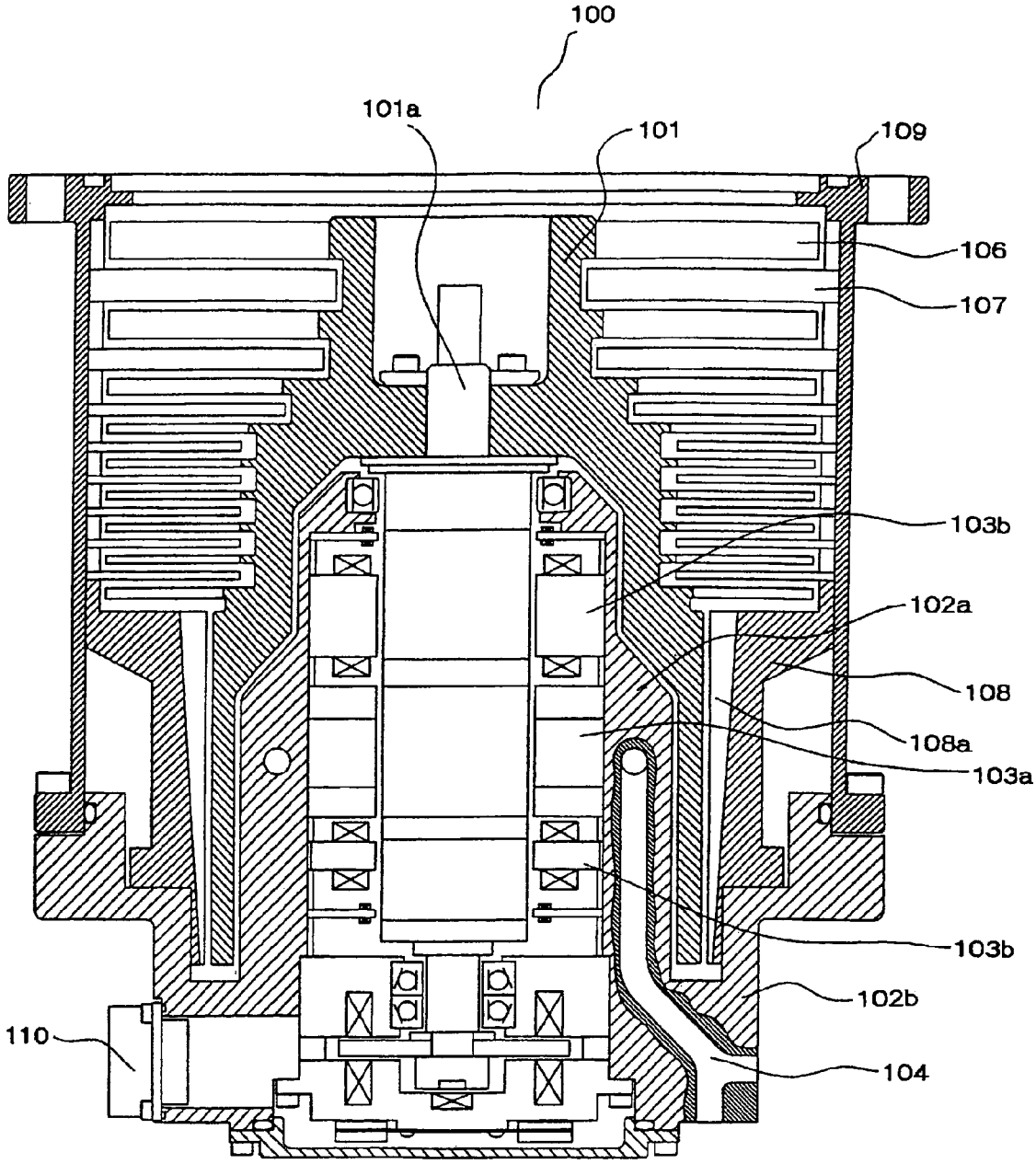
FIG. 1 is a sectional view of a vacuum pump in accordance with a first example of the invention.
Figure 2:
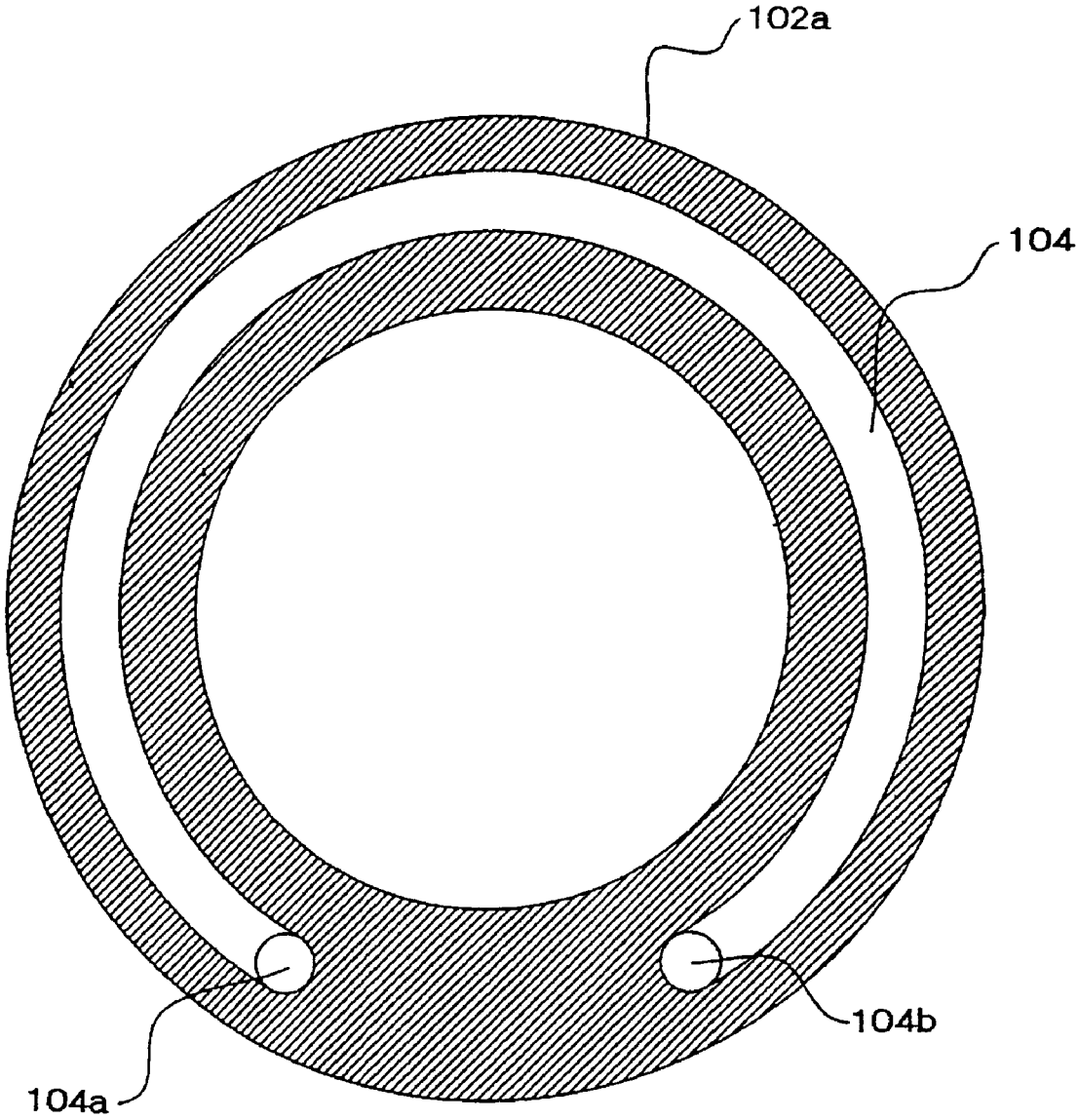
FIG. 2 is a horizontal sectional view at a position where a cooling water pipe is buried in a stator column of the vacuum pump in accordance with the first example.
Figure 3:
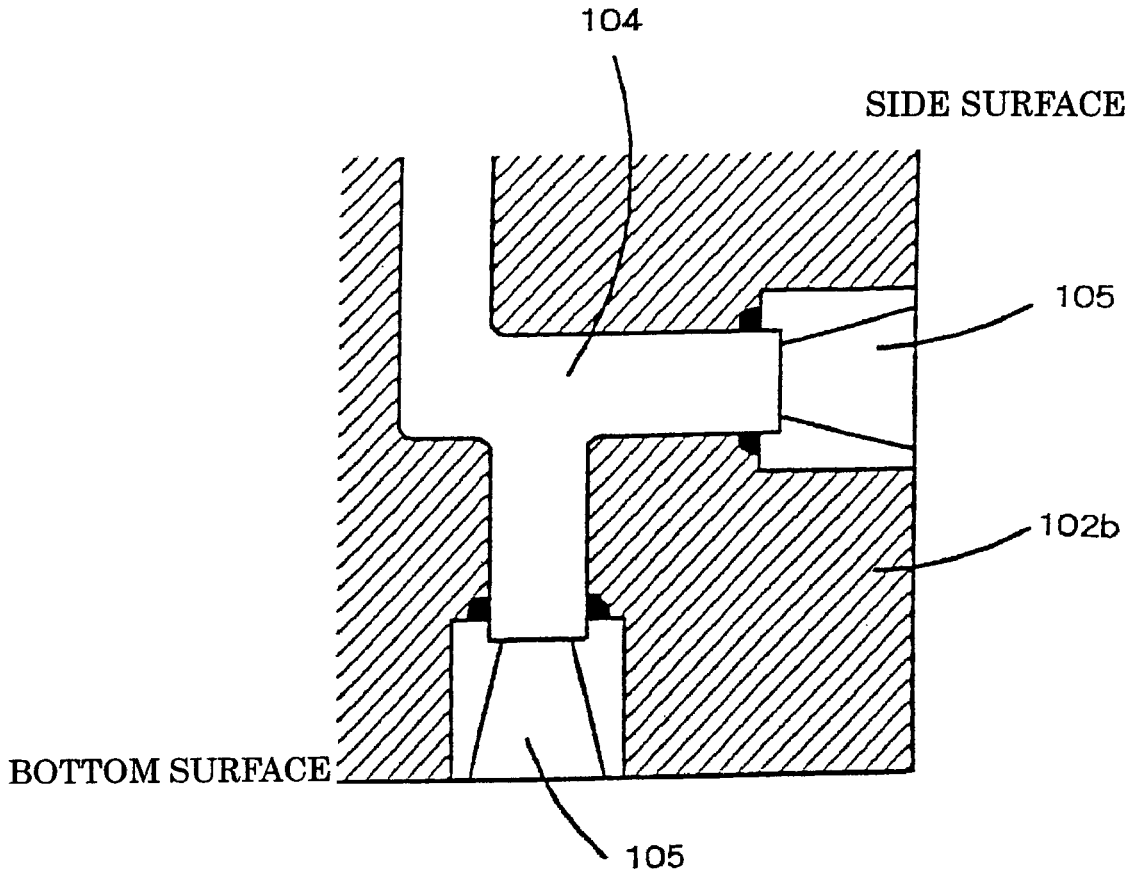
FIG. 3 is an enlarged sectional view of an end of a cooling water pipe of the vacuum pump in accordance with the first example.
Figure 4A:
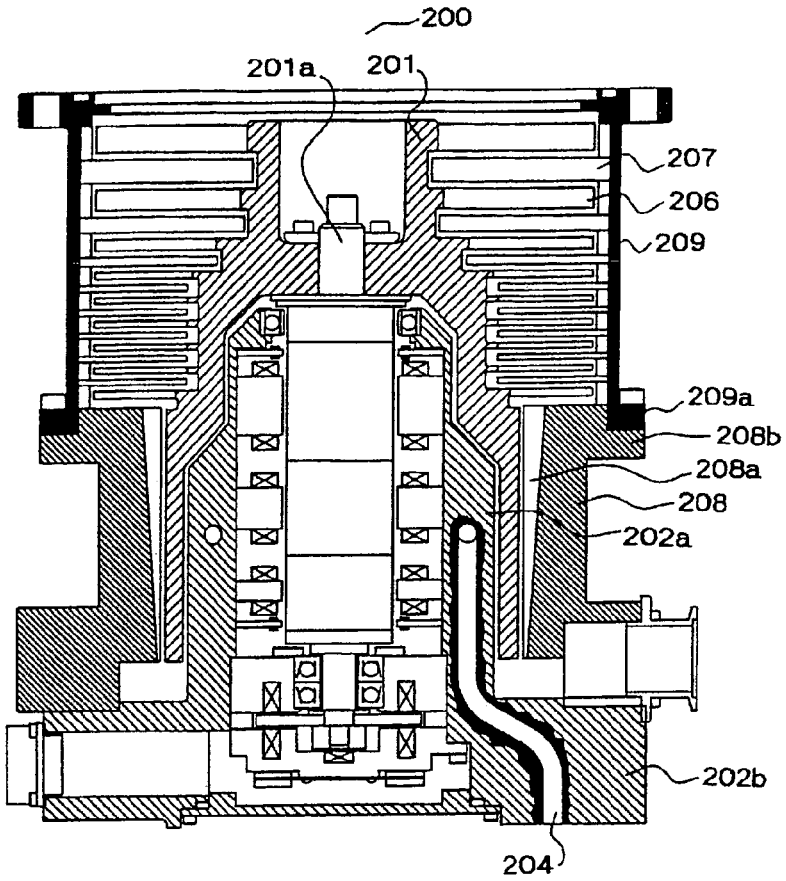
FIG. 4(*a*) is a sectional view of a vacuum pump in accordance with a second example of the invention, and FIG. 4(*b*) is a sectional view of a vacuum pump having another shape in accordance with the second example.
Figure 4B:
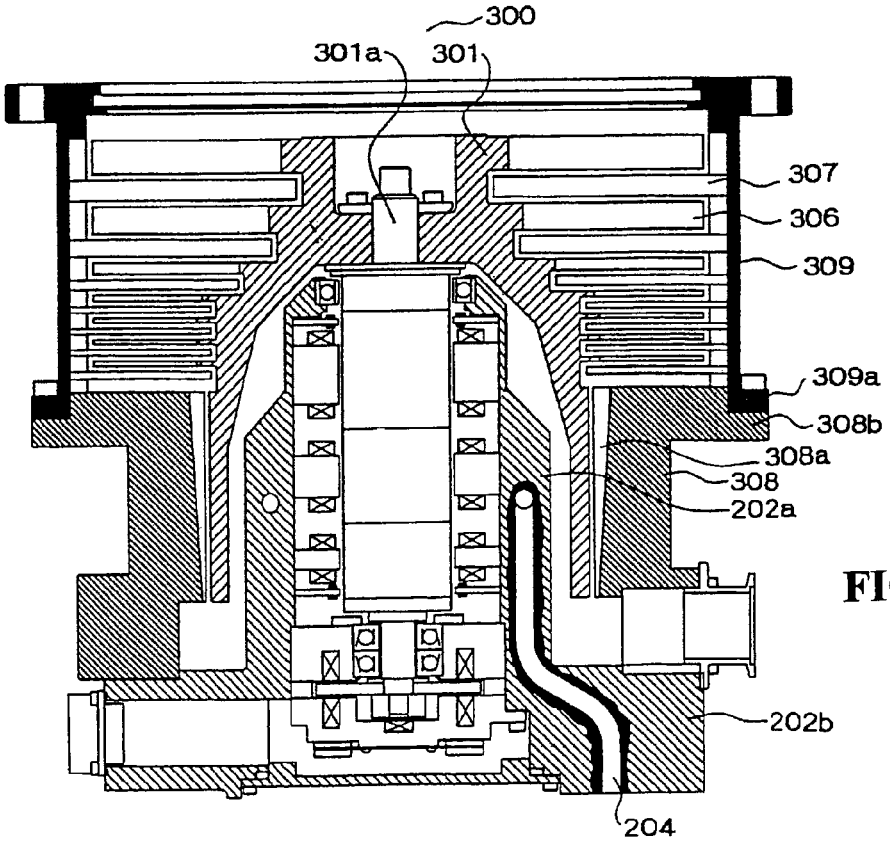
Figure 5:
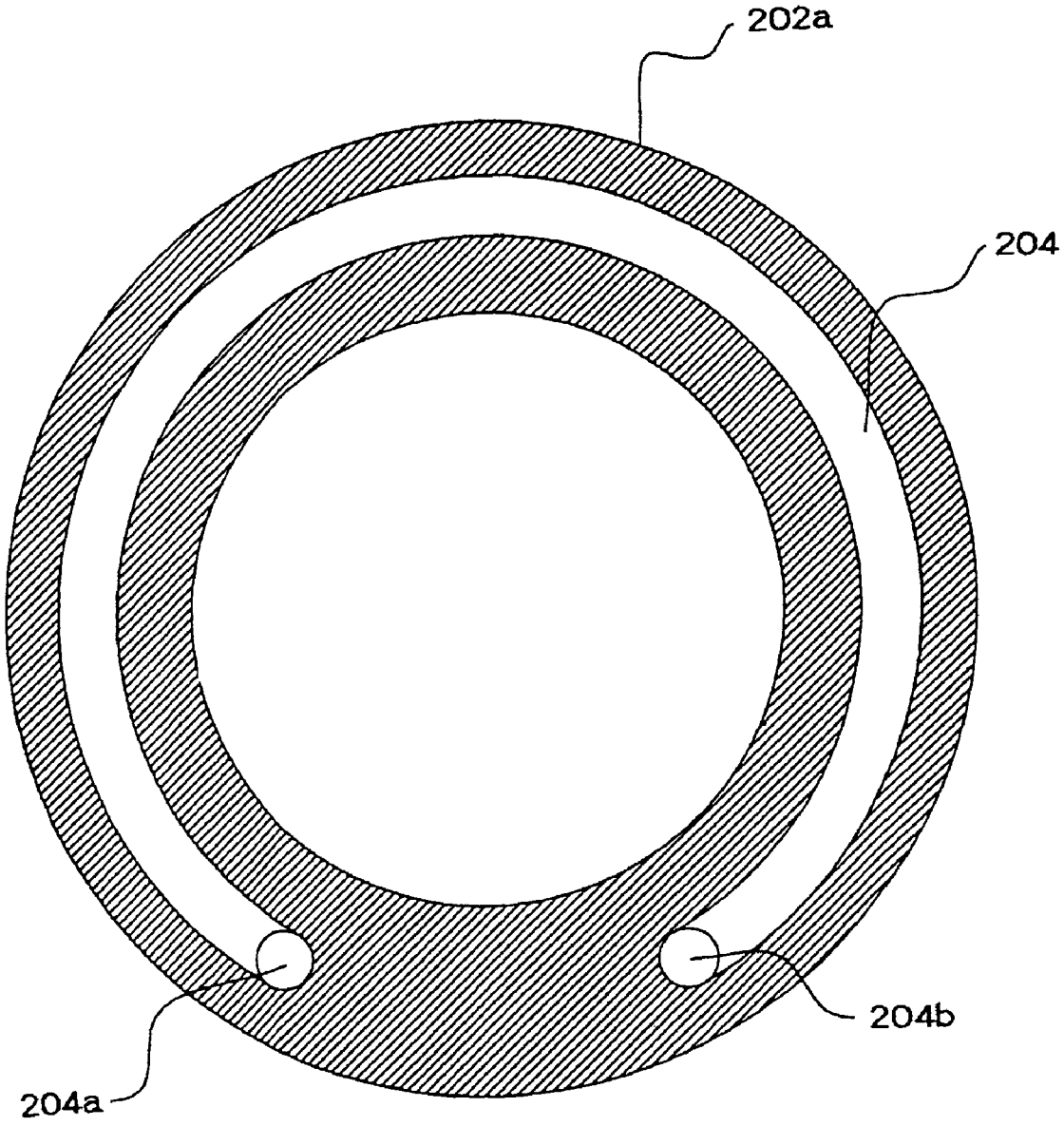
FIG. 5 is a horizontal sectional view at a position where a cooling water pipe is buried in a stator column of the vacuum pumps shown in FIG. 4(*a*) or 4(*b*)
Figure 6:
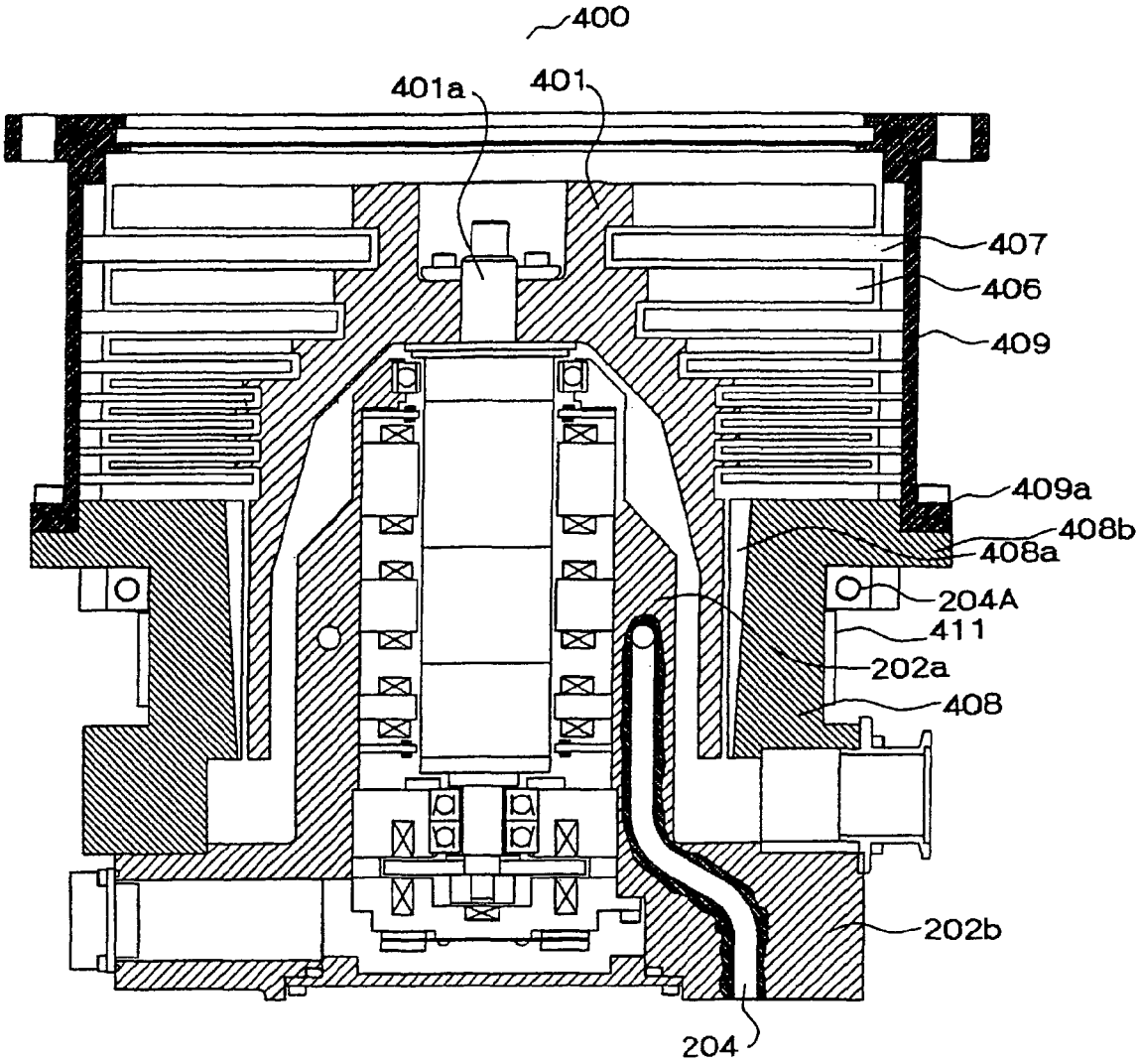
FIG. 6 is a sectional view of a vacuum pump of another embodiment in accordance with the second example.
Figure 7:
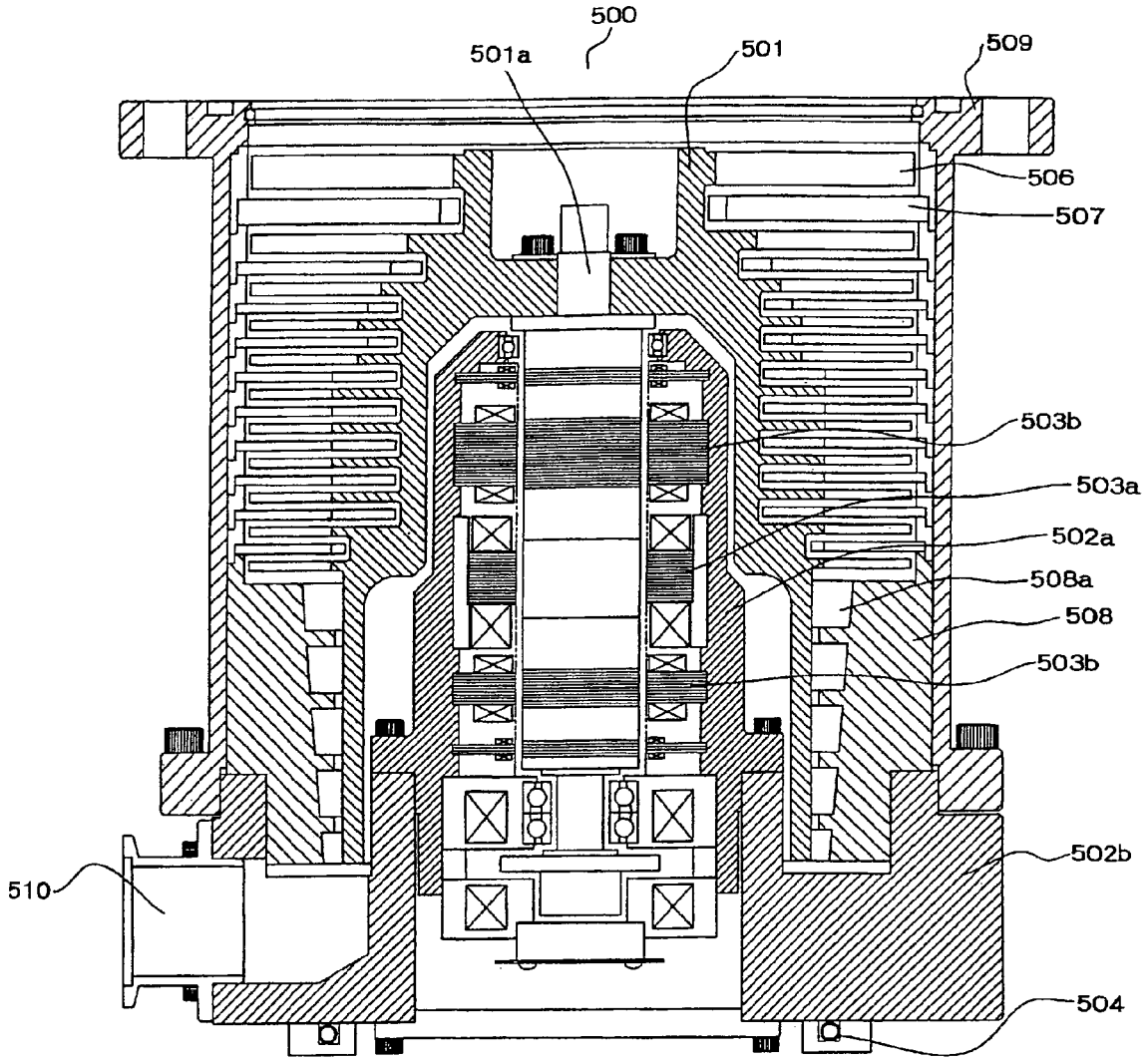
FIG. 7 (PRIOR ART)
FIG. 7 is a sectional view of a conventional vacuum pump relating to the first example.
Figure 8A:
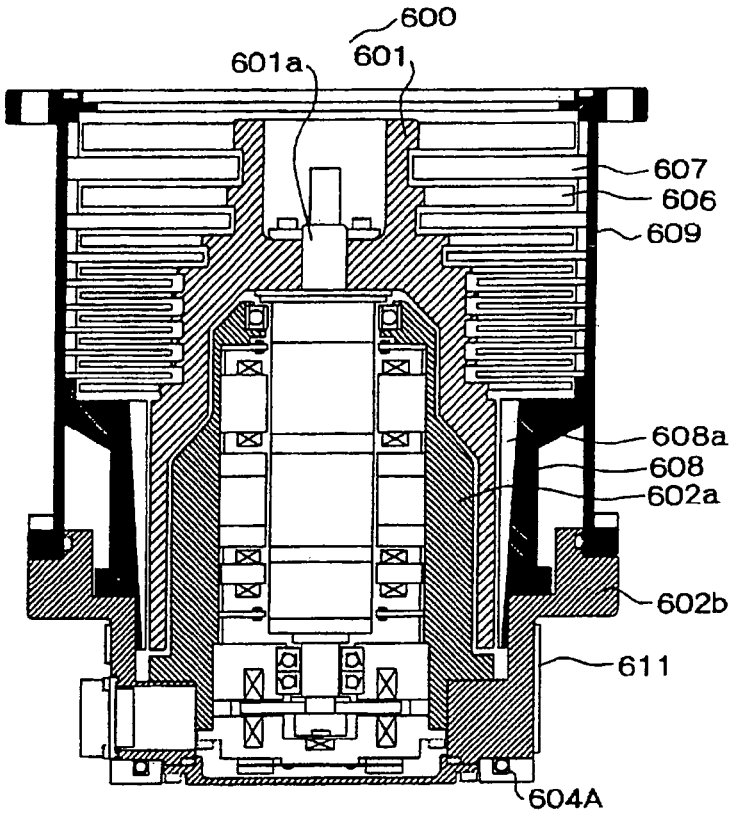
FIG. 8(*a*) is a sectional view of a conventional vacuum pump relating to the second example, and FIG. 8(*b*) is a sectional view of a conventional vacuum pump having another shape relating to the second example.
Figure 8B:
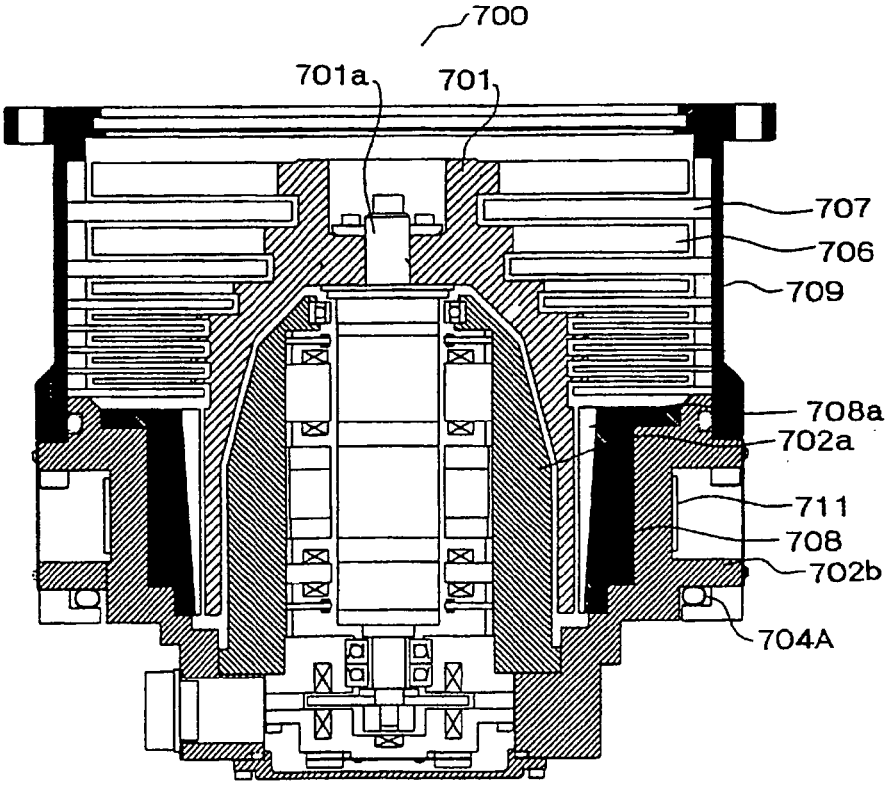

100 vacuum pump
101 rotor
101*a* rotor shaft
102*a* stator column
102*b* base
103*a* drive motor
103*b* magnetic bearing
104 cooling water pipe
104*a* water supply port
104*b* water drain port
105 joint
106 rotating blade
107 stationary blade
108 thread stator
108*a* thread groove
109 pump case
110 electrical cord takeoff port
204A (second) cooling water pipe
408 thread pump stator
408*a* flange
409*a* fastening portion
411 heater

The invention claimed is:

1. A vacuum pump which generates vacuum by sucking and discharging a gas, comprising:

a pump case for the vacuum pump;

a thread pump stator that supports the pump case;

a base that supports the thread pump stator;

a stator column formed integrally with the base;

a rotor arranged so as to cover the stator column;

rotating blades provided in multiple stages at the outer periphery of the rotor; and a cooling water pipe buried in the wall of the stator column, one end of the cooling water pipe being branched into a plurality of water inlet ports and another end of the cooling water pipe being branched into a plurality of water outlet ports, wherein one water inlet port and one water outlet port are communicated with an outside of the vacuum pump at a side surface of the base, and another water inlet port and another water outlet port are communicated with the outside of an vacuum pump at a bottom surface of the base.

2. A vacuum pump according to claim 1; wherein the pump case has a fastening portion which is fastened to the thread pump stator to support the pump case, and the thread pump stator has a flange which extends from the thread pump stator and fastens the pump case to support the pump case.

3. A vacuum pump according to claim 1; wherein an external casing of the vacuum pump is formed by the pump case, the thread pump stator, and the base.

4. A vacuum pump according to claim 1; wherein in the vacuum pump, the inner peripheral surface shape of the rotor and the outer peripheral surface shape of the stator column are different from each other.

5. A vacuum pump according to claim 1; further comprising a second cooling water pipe arranged on the outer surface of the thread pump stator.

6. A vacuum pump according to claim 1; further comprising a heater arranged on the outer surface of the thread pump stator.

7. A vacuum pump according to claim 1; further comprising a plurality of joints which are fixed to each end of the cooling water pipe and buried in the vacuum pump flush with the external surface of the pump.

8. A vacuum pump according to claim 7; wherein the joints and the cooling water pipe are formed of the same metal.

9. A vacuum pump which generates vacuum by sucking and discharging a gas, comprising:

a pump case for the vacuum pump;

a base arranged below the pump case;

a thread pump stator arranged on the base;

a stator column formed integrally with the base;

a rotor arranged so as to cover the stator column;

rotating blades provided in multiple stages at the outer periphery of the rotor; and a cooling water pipe buried in the wall of the stator column, one end of the cooling water pipe being branched into a plurality of water inlet ports and another end of the cooling water pipe being branched into a plurality of water outlet ports, wherein one water inlet port and one water outlet port are communicated with an outside of the vacuum pump at a side surface of the base, and another water inlet port and another water outlet port are communicated with a outside of the vacuum pump at a bottom surface of the base.

10. A vacuum pump according to claim 9; further comprising a heater arranged on the outer surface of the thread pump stator.

11. A vacuum pump according to claim 9; further comprising a plurality of joints which are fixed to each end of the cooling water pipe and buried in the vacuum pump flush with the external surface of the pump.

12. A vacuum pump according to claim 11; wherein the joints and the cooling water pipe are formed of the same metal.

13. A vacuum pump for evacuating gas from a chamber to create a vacuum in the chamber, the vacuum pump comprising:

a rotor;

an electrical equipment section that rotatably supports and rotationally drives the rotor;

a stator that has a thread pump section and that coacts with the rotor to evacuate gas from the chamber by suction in response to rotation of the rotor;

a stator column that is integral with the stator and that contains the electrical equipment section; and a cooling water pipe buried in a wall of the stator column, the cooling water pipe having a water inlet end portion buried in the wall and a water outlet end portion buried in the wall, the water inlet end portion branching into a plurality of water inlet ports and the water outlet end portion branching into a plurality of water outlet ports, wherein one branched water inlet port and one branched water outlet port open to the outside of the vacuum pump at a side surface of the stator column, and another branched water inlet port and another branched water outlet port open to the outside of the vacuum pump at an underside of the stator column.

* * * * *